US009055786B2

(12) United States Patent
Savoie

(10) Patent No.: US 9,055,786 B2
(45) Date of Patent: Jun. 16, 2015

(54) CLEAT ATTACHMENT SYSTEM

(75) Inventor: Armand J. Savoie, Gardner, MA (US)

(73) Assignee: CLEATS LLC, Marlborough, MA (US)

( * ) Notice: Subject to any disclaimer, the term of this patent is extended or adjusted under 35 U.S.C. 154(b) by 642 days.

(21) Appl. No.: 13/214,323

(22) Filed: Aug. 22, 2011

(65) Prior Publication Data

US 2012/0047775 A1 Mar. 1, 2012

Related U.S. Application Data

(60) Provisional application No. 61/377,135, filed on Aug. 26, 2010.

(51) Int. Cl.

| | |
|---|---|
| ***A43B 5/00*** | (2006.01) |
| ***A43B 13/14*** | (2006.01) |
| ***A43B 15/00*** | (2006.01) |
| ***A43C 15/16*** | (2006.01) |

(52) U.S. Cl.

CPC ..... *A43C 15/161* (2013.01); *A43C 15/16* (2013.01); *A43B 5/001* (2013.01)

(58) Field of Classification Search

CPC ..... A43B 5/001; A43C 15/161–15/168; A43C 15/00; A43C 15/16

USPC ..... 36/134, 67 D, 62, 65, 127

See application file for complete search history.

(56) References Cited

U.S. PATENT DOCUMENTS

| | | | | |
|---|---|---|---|---|
| 4,633,600 A * | 1/1987 | Dassler et al. | ..... | 36/134 |
| 5,123,184 A | 6/1992 | Ferreira | ..... | 361/34 |
| 5,524,367 A | 6/1996 | Ferreira et al. | ..... | 36/134 |
| 5,768,809 A | 6/1998 | Savoie | ..... | 36/134 |
| 5,974,700 A | 11/1999 | Kelly | ..... | 36/134 |
| 6,108,944 A | 8/2000 | Savoie | ..... | 36/134 |
| 6,151,805 A | 11/2000 | Savoie | ..... | 36/134 |
| 6,272,774 B1 | 8/2001 | Kelly | ..... | 36/134 |
| 6,463,681 B1 | 10/2002 | Savoie | ..... | 36/134 |

(Continued)

FOREIGN PATENT DOCUMENTS

| | | | |
|---|---|---|---|
| CN | 1395469 A | 2/2003 | ..... A23C 15/16 |
| CN | 1395472 A | 2/2003 | ..... A43C 15/16 |

(Continued)

OTHER PUBLICATIONS

International Searching Authority, International Search Report for PCT/US2011/048572 Jan. 4, 2012.

(Continued)

*Primary Examiner* — Jila M Mohandesi

(74) *Attorney, Agent, or Firm* — Sunstein Kann Murphy & Timbers LLP

(57) ABSTRACT

A cleat attachment system for footwear. The cleat includes a cylinder on a base with one or more locking tabs disposed around the outside of the cylinder. The receptacle includes a cylindrical cavity with one or more locking tabs on the cavity's inner surface. A cleat attaches to a receptacle embedded in footwear by inserting the cleat attachment structure into the receptacle, after ramps on the cleat attachment structure and the receptacle are oriented with respect to each other. The locking tabs engage to retain the cleat in the receptacle. Corresponding ramps on the cleat attachment structure and the receptacle cooperate to disengage the locking tabs when the cleat attachment structure is twisted about its axis. The cleat is thereby detached from the receptacle.

24 Claims, 10 Drawing Sheets

(56) References Cited

U.S. PATENT DOCUMENTS

| | | | | |
|---|---|---|---|---|
| 6,708,428 | B2 * | 3/2004 | Chen | 36/134 |
| 6,826,854 | B2 | 12/2004 | Ijiri | 36/134 |
| 2002/0056210 | A1 | 5/2002 | Kelly et al. | 36/127 |
| 2003/0131502 | A1 | 7/2003 | Terashima | 36/127 |
| 2003/0188459 | A1 * | 10/2003 | Kelly et al. | 36/134 |
| 2005/0160629 | A1 | 7/2005 | Jungkind | |
| 2009/0211116 | A1 * | 8/2009 | Chen et al. | 36/134 |
| 2010/0257751 | A1 * | 10/2010 | Burt et al. | 36/66 |

FOREIGN PATENT DOCUMENTS

| | | | | |
|---|---|---|---|---|
| CN | 1406535 | A | 4/2003 | A43C 15/02 |
| CN | 1652705 | A | 8/2005 | A43B 13/26 |
| CN | 1984578 | | 6/2007 | A43C 15/16 |
| CN | 1984578 | A | 6/2007 | A43C 15/16 |
| CN | 101048086 | | 10/2007 | A43C 15/16 |
| CN | 101048086 | A | 10/2007 | A43C 15/16 |
| EP | 0 193 024 | A1 | 9/1986 | |
| WO | WO 01/54527 | A1 | 8/2001 | A43C 15/16 |
| WO | WO 01/54528 | A1 | 8/2001 | A43C 15/16 |
| WO | WO 02/39840 | A1 | 5/2002 | |
| WO | WO 03/086129 | A1 | 10/2003 | A43B 13/26 |

OTHER PUBLICATIONS

International Searching Authority, International Written Opinion for PCT/US2011/048572 Jan. 4, 2012.

Chinese Patent Office Office Action and Search Report pertaining to Chinese Application No. 201180041387.X, dated Dec. 25, 2014, 9 pages.

Chinese Patent Office Office Action and Search Report pertaining to Chinese Application No. 201180041387.X, dated Dec. 25, 2014, 15 pages.

* cited by examiner

CLEAT ATTACHMENT SYSTEM

RELATED APPLICATION

The present application claim priority from provisional application No. 61/377,135, filed Aug. 26, 2010. This application is incorporated herein by reference.

TECHNICAL FIELD

This invention relates to the mounting of traction gear on the bottom of footwear, in particular, athletic footwear.

BACKGROUND

Progress has been made in recent years in reducing the labor involved in installing traction cleats into the outsoles of athletic shoes. For example, removable cleats employing the Q-LOK™ attachment structure, the TRI-LOK™ attachment structure, or the FASTTWIST™ attachment structure require less than a full turn to install the cleat into the mating receptacle. (Q-LOK™ is described in U.S. Pat. Nos. 5,768,809, 6,151,805, 6,108,944, and 6,463,681, while Fast Twist™ is described in U.S. Pat. Nos. 5,123,184, 5,524,367, 5,974,700 and 6,272,774, each of which patents is incorporated by reference herein in its entirety.) Because each athletic shoe usually includes many cleats, these attachment structures represented a step forward from previous systems that required multiple turns per cleat. However, some partial-turn cleat systems can introduce some uncertainty as to whether the cleat has been turned sufficient degrees to firmly mate with the receptacle. A system and method for installing cleats into athletic footwear that offers the labor savings of partial-turn cleat attachment system with increased certainty of proper cleat installation is desirable.

SUMMARY OF PREFERRED EMBODIMENTS OF THE INVENTION

In a preferred embodiment of the present invention, an attachment structure is provided for a removable cleat for footwear. The attachment structure includes a cleat base and a cylindrical structure projecting from the base. The cylindrical structure includes at least one ramp and one or more locking tabs, disposed about the outer surface of the structure. The ramp extends from the end of the cylindrical structure, distal to the base, towards the other end of the cylindrical structure, which end is proximate to the cleat base. The locking tab or tabs cooperate with corresponding tabs on the mating receptacle to retain the cleat attachment structure in the receptacle after insertion. Insertion may be accomplished by snapping the cleat onto the receptacle. The ramp cooperates with a corresponding ramp on the receptacle to dislodge the locking tabs when the cleat is rotated about the central axis of the cylindrical structure. Thus, the cleat can be disengaged from the receptacle and removed from the footwear.

In another preferred embodiment of the invention, a receptacle is provided that mates with the cleat attachment structure. The receptacle includes a base and a cylindrical cavity in the base. The inner surface of the cavity includes one or more locking tabs together with at least one ramp extending from the closed end of the cavity towards the open end of the cavity.

The cleat attachment structure and the receptacle form an attachment system for a removable cleat to footwear. To install the cleat into the receptacle, the central axis of the cylindrical structure of the cleat is aligned with the central axis of the receptacle's central cavity, and the cleat is rotated so that corresponding ramps on the cleat and receptacle are aligned. The cleat is then pushed into the receptacle engaging the locking tabs and the ramps on cleat and receptacle to lock the receptacle with the cleat. Removal is also straightforward: when the cleat is twisted, the ramps on the cleat attachment structure and the receptacle cooperate to force the cleat and receptacle apart, dislodging the locking tabs, and allowing the cleat to be removed from the footwear.

In a preferred embodiment, the cleat attachment structure includes a cylindrical core disposed about the central axis and within a perimeter defined by the cylinder. This cylindrical core may be used, in conjunction with corresponding structure in the receptacle, to help align the cleat with the receptacle for attachment of the cleat to the shoe. This cylindrical core preferably includes a flange with a vertically oriented wall adapted to cooperate with a corresponding wall in the receptacle to resist rotation of the attachment about its central axis. Preferably, the height of the core is greater than the height of the cylinder.

Similarly, in a preferred embodiment, the receptacle includes an inner cylindrical wall defining an inner cylindrical opening disposed about the central axis and within the cavity. This inner cylindrical opening is adapted to receive the cylindrical core of the cleat attachment structure. This inner cylindrical opening preferably includes a slot with a vertically oriented wall adapted to cooperate with the corresponding wall in the attachment structure's core to resist rotation of the attachment structure about the central axis. Preferably, the height of the inner cylindrical opening is greater than the height of the receptacle's cavity.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

As used in this description and the accompanying claims, the following term shall have the meaning indicated, unless the context otherwise requires: "Footwear" means any outer covering for a foot including, without limitation, athletic footwear, sandals, boots, shoes and slippers.

In preferred embodiments of the invention, a traction cleat attachment system for footwear is provided. The system comprises a cleat attachment structure and a receptacle. The cleat attachment structure includes a cylindrical structure on a base with one or more locking tabs disposed around the outside of the cylinder. The receptacle includes a cylindrical cavity with one or more locking tabs on its inner surface. The cleat attachment structure mates with the receptacle by aligning the axis of the cylinder with the axis of the cylindrical cavity and pushing one into the other, thereby engaging the locking tabs. Ramps on the cleat attachment structure and the receptacle cooperate to disengage the locking tabs when the cleat attachment structure is twisted about its axis. The cleat attachment structure is thereby detached from the receptacle. Note that the ramp or ramps on the cleat must be aligned with the corresponding ramp or ramps on the receptacle before the cleat attachment structure and receptacle are mated.

Figure 1:
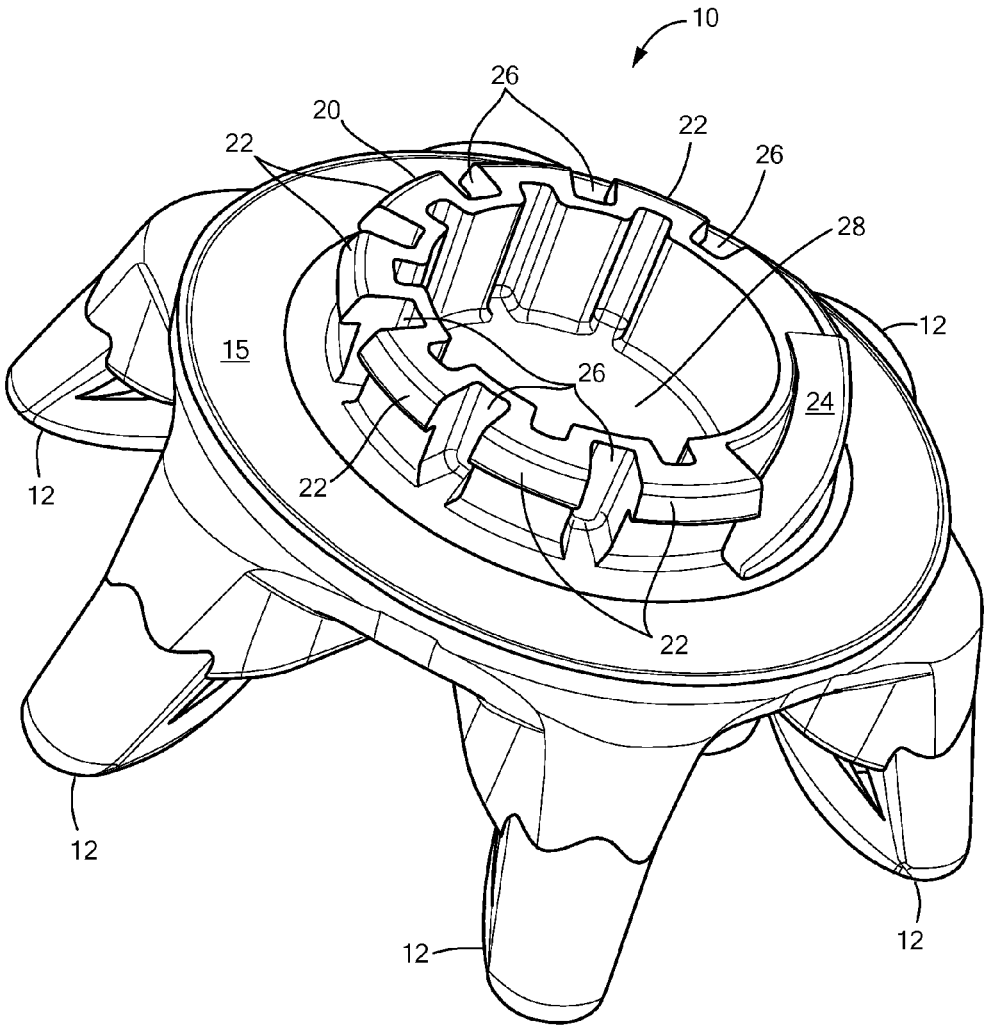
FIG. 1 is a top perspective view of a removable cleat for footwear, according to an embodiment of the invention.
Figure 2:
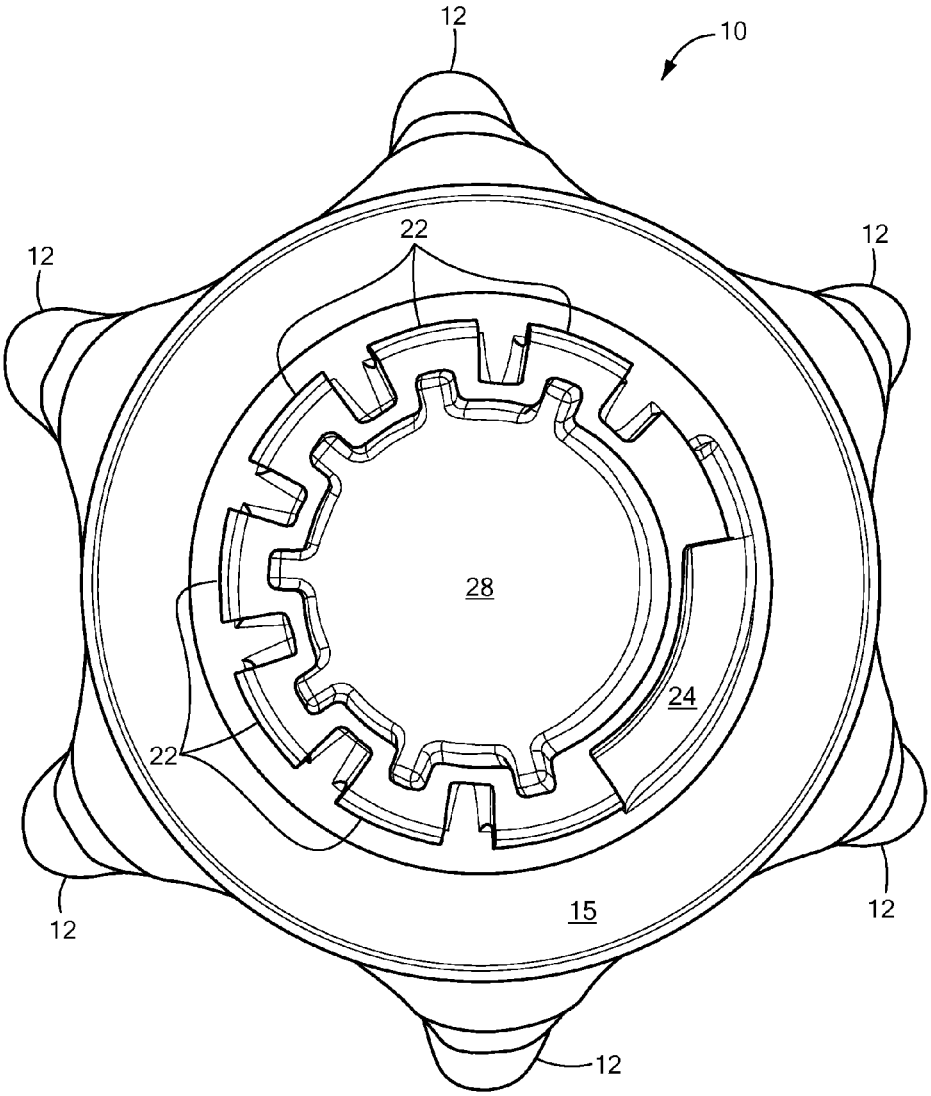
FIG. 2 is a top view of the cleat of FIG. 1; this view is along the central axis of the cylindrical structure of the cleat's attachment structure.

FIG. 1 shows a traction cleat 10 with a cleat attachment structure according to a preferred embodiment of the invention. FIG. 2 is another view of the cleat attachment structure of FIG. 1. The cleat attachment structure allows the traction cleat to securely be attached to a receptacle embedded in footwear. The traction cleat in this embodiment includes a plurality of traction legs 12 for gripping a surface. The traction legs 12 are attached to one surface of a cleat base 15. (Other types of gripping structures may be used instead of a plurality of traction legs; for example, a single metal spike may be used, or a plurality of ridges or bumps may be used.) This surface of the cleat base will be called a "bottom surface" of the cleat for purposes of description. Terms such as "top" and "bottom" as used herein are for purposes of description and are not intended to describe an absolute orientation in space, but are intended to evoke the orientation of a properly installed cleat and receptacle when the wearer of the footwear is standing on the ground; thus, when a cleat is in use, a "bottom" surface would normally face the ground, and a "top" surface would face the bottom of a wearer's foot.

The cleat attachment structure consists of a cylindrical structure 20 or "cylinder" attached to an opposing face of the cleat base, which will be called the "top surface" of the cleat base 15 for purposes of description. Likewise, the end of the cylinder 20 attached to the cleat base will be called the "bottom" end of the cylinder for purposes of description. The outer surface of the cylinder 20 includes a plurality of locking tabs 22. The locking tabs engage with one or more corresponding locking tabs on the inner surface of a cylindrical cavity in a receptacle in the footwear outsole. The engagement of the locking tabs retains the cleat attachment structure in the receptacle. In this embodiment, slots 26 are formed in the walls of the cylinder 20, and the cylinder defines a cavity 28. In this description and in any appended claims, the term "cylinder" will include cylindrical structures with such slots and cavities. The slots 26 facilitate flexing of the tabs 22 as the tabs engage a corresponding locking tab or tabs in the receptacle. Other embodiments may not include such slots and/or may not include such a cavity. Further, in some embodiments of the invention, the cleat attachment structure may include differing numbers of locking tabs, including a single locking tab. The width of each locking tab may vary in various preferred embodiments to vary the force needed to insert the cleat into the receptacle and the force needed to disengage the cleat from the receptacle. Preferably, the locking tabs are disposed on a sector of the cylinder extending greater than 180 degrees around the cylinder.

The cleat attachment structure also includes a ramp 24. The ramp 24 extends from the top end of the cylinder 20 towards the bottom end of the cylinder. Preferably, the ramp is disposed on a sector of the cylinder extending less than 90 degrees around the cylinder.

The ramp 24 mates with a corresponding ramp in a cylindrical cavity in the receptacle. Ramps on the cleat attachment structure and receptacle are aligned prior to insertion of the cleat attachment structure into the receptacle cavity. When only one ramp is provided on the cleat attachment structure, alignment of the cleat attachment structure ramp to the corresponding ramp in the receptacle cavity determines the orientation of the cleat to the receptacle and, thus, to the shoe outsole that contains the receptacle. When an installed cleat is twisted about the central axis of the cylindrical structure 20, these ramps translate the cleat attachment structure vertically along the central axis, relative to the receptacle. This axial movement disengages the locking tabs of cleat and receptacle, allowing the cleat to be removed from the footwear.

In some embodiments of the invention, more than one ramp is provided on the cleat attachment structure. In specific embodiments of the invention, when more than one ramp is provided on the cleat attachment structure, the ramps may be situated symmetrically about the cylinder so that more than one rotational position is possible for the cleat with respect to the receptacle, when cleat and receptacle are mated.

Figure 3:
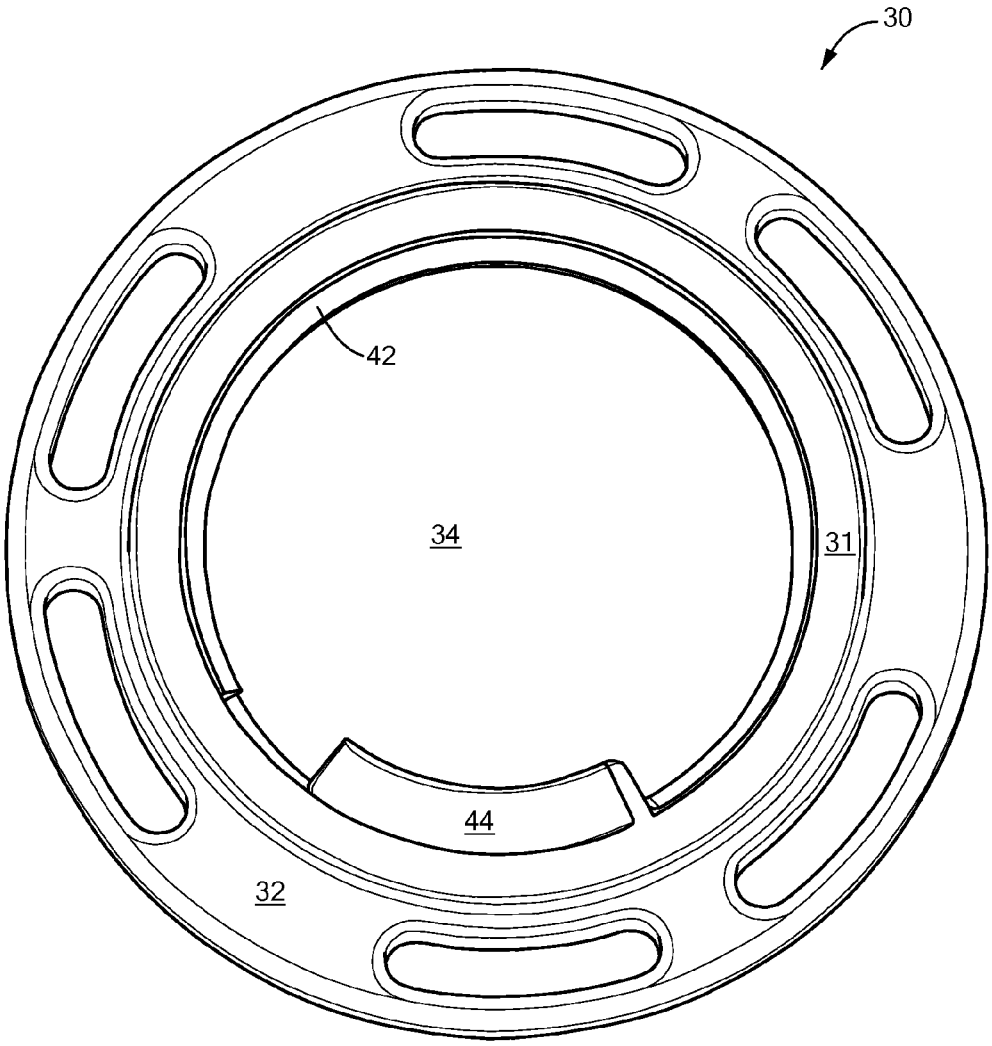
FIG. 3 is a bottom view of a receptacle that receives a cleat attachment structure, such as the cleat attachment structure on the cleat of FIG. 1, according to an embodiment of the invention; the view is along the central axis of the receptacle's cylindrical cavity.
Figure 4:
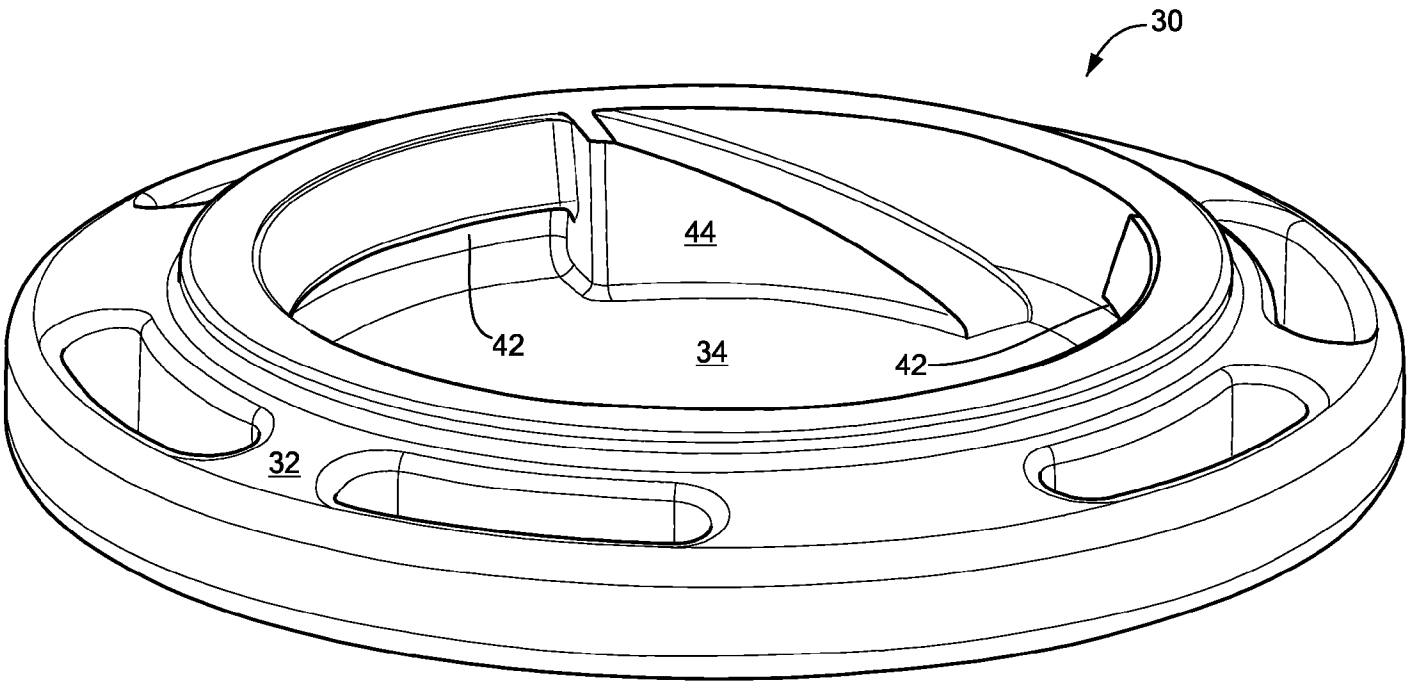
FIG. 4 is a bottom perspective view of the receptacle of FIG. 3.

FIG. 3 shows the bottom face of a receptacle 30 that receives a cleat attachment structure, according to an embodiment of the invention. The view is along the central axis of the receptacle's cylindrical cavity 34. FIG. 4 shows the receptacle of FIG. 3 in a perspective view. The receptacle 30 includes a flange 32 that can be molded into the outsole of footwear, to retain the receptacle in the outsole. The cylindrical cavity 34 is defined by a wall 31 and includes a ramp 44 and a locking tab 42. The ramp 44 cooperates with the corresponding ramp of the cleat attachment structure to disengage the cleat and receptacle when the cleat is twisted, as described above. Preferably, the ramp 44 is disposed on a sector of the cylindrical cavity 34 extending less than 90 degrees around the cylindrical cavity.

The locking tab 42 cooperates with the corresponding locking tabs on the cleat attachment structure to retain the cleat attachment structure in the receptacle after insertion. In this embodiment, a single locking tab 42 is provided. In other embodiments, a plurality of locking tabs may be provided for the receptacle and for the mating cleat attachment structure. The width of the tabs may vary to accommodate differing levels of insertion force and retention force for the corresponding cleat attachment structure. All tabs need not have the same width in each embodiment. Preferably, the locking tab 42 is (or a plurality of locking tabs are) disposed along a sector of the cylindrical cavity 34 extending greater than 180 degrees around the cylindrical cavity 34.

To install the cleat in the receptacle, the cleat and receptacle are placed adjacent each other so that the top of the cleat and the bottom of the receptacle are facing each other and so that the ramps of the cleat and receptacle are lined up with each other. Then, the cleat is simply pushed and snapped into place in the receptacle, so that the locking tabs on each of the cleat and the receptacle overlap each other to hold the cleat in the receptacle. Thus, the cleat is relatively easy to install, merely requiring an aligning of the cleat with the receptacle and snapping the cleat into the receptacle. As discussed above, the cleat may be removed relatively easily by twisting the cleat with respect to the receptacle, preferably with a cleat wrench. Turning the cleat causes the ramps of the cleat and the receptacle to interact with each other, causing the cleat to move axially with respect to the receptacle, and in turn causing the locking tabs to bend so as to overcome the force of the locking tabs holding the cleat in place. This action causes the cleat to be popped out of the receptacle with a simple twist of the cleat, a twist that is less than a half turn and, indeed, preferably less than a quarter turn.

Figure 5:
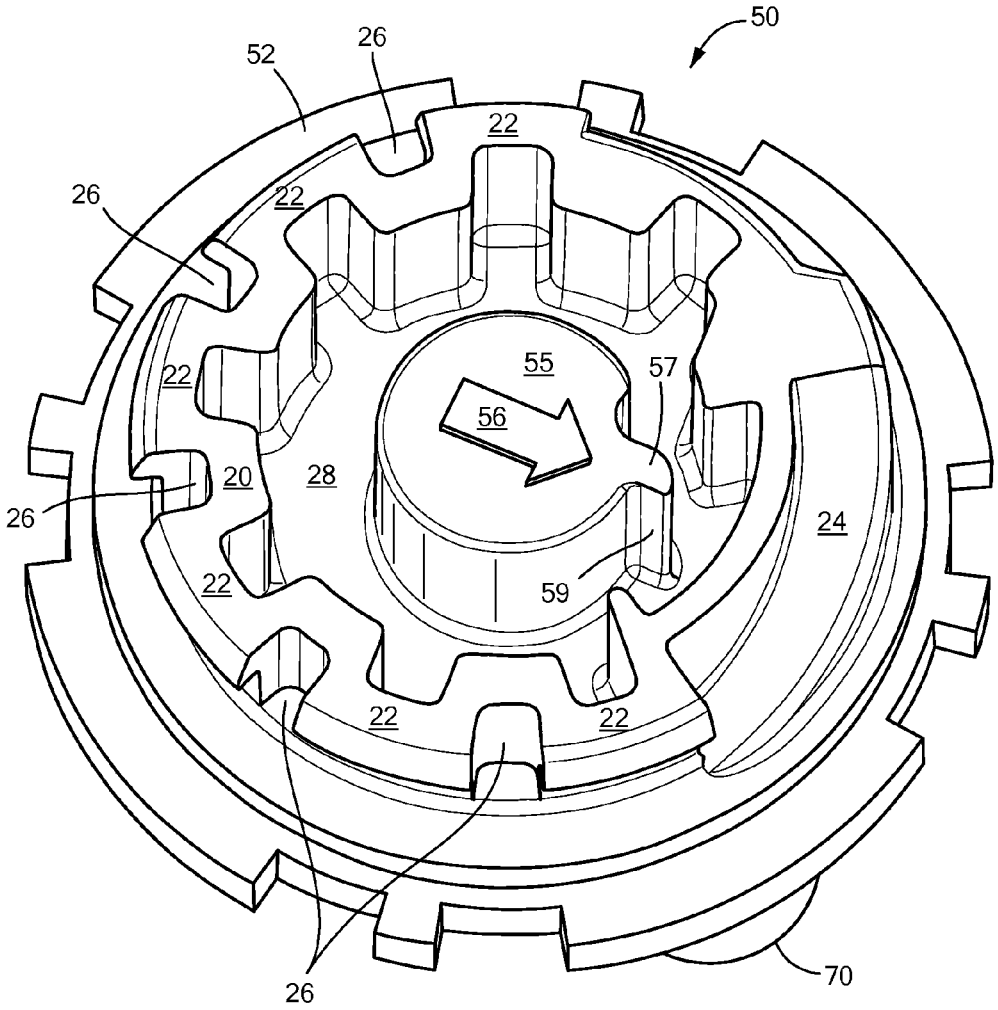
FIG. 5 is a top perspective view of an attachment structure for a removable cleat, according to an alternative embodiment of the invention.
Figure 6:
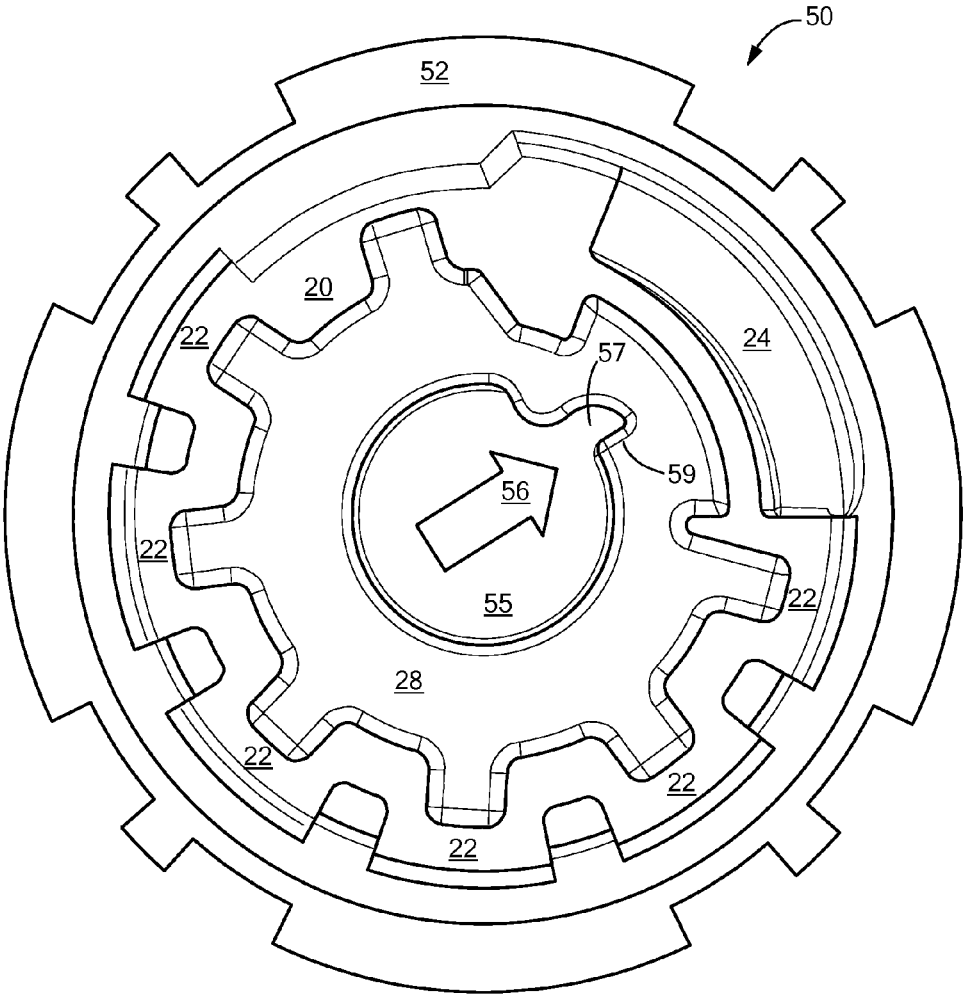
FIG. 6 is a top view of the cleat attachment structure of FIG. 5; the view is along the central axis of the cylindrical cavity of the attachment structure.
Figure 7:
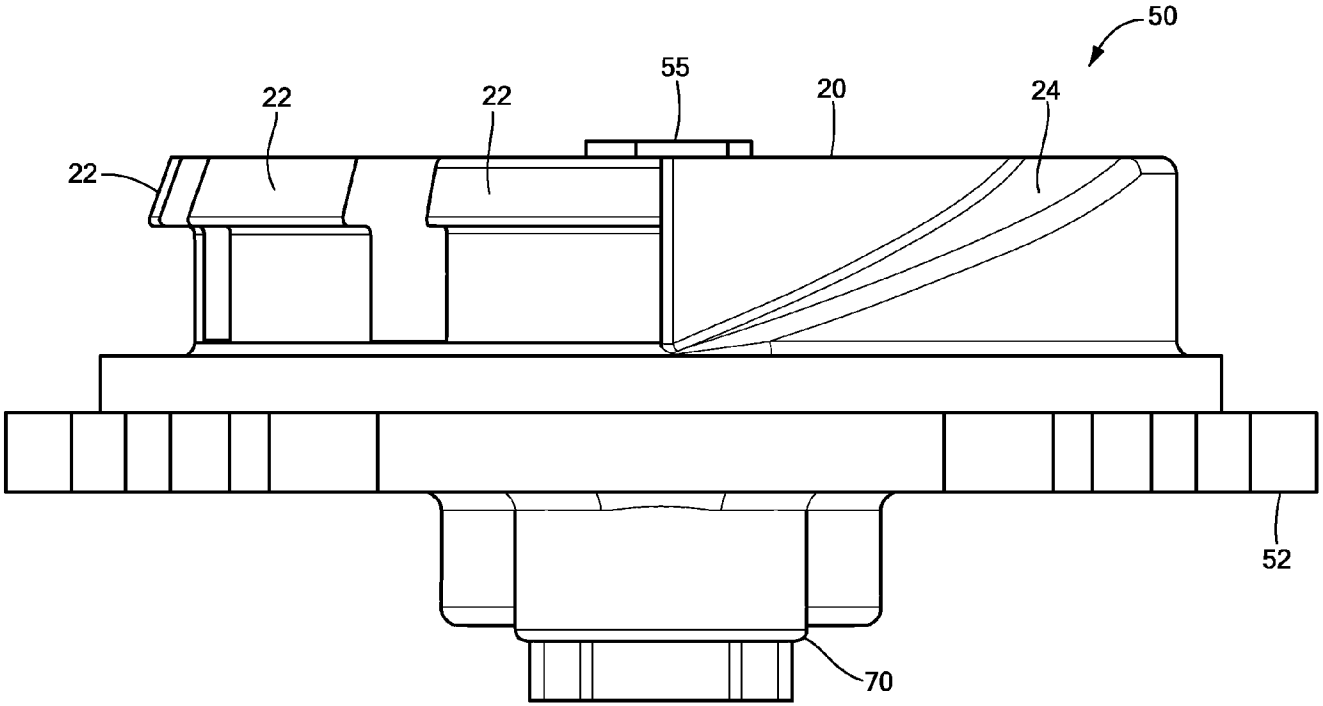
FIG. 7 is a side view of the cleat attachment structure of FIG. 5.

FIGS. 5, 6 and 7 show an alternative embodiment of an attachment structure 50 for a removable cleat, according to an alternative embodiment of the invention. This attachment structure 50 may be molded into—or otherwise connected to—a gripping structure, which may, for example, include a plurality of traction legs, a metal spike or other structure to provide traction on a surface. The attachment structure 50 of FIGS. 5, 6 and 7 includes a flange 52 that can be molded into the rest of a cleat, to fixedly connect the attachment structure to the traction-providing structure. The attachment structure 50 may include wrench holes 70 for accepting the cleat wrench that is used to twist the cleat out of the receptacle. FIG. 5 is a top perspective view of the attachment side of the attachment structure, FIG. 6 is a top view of the attachment structure of FIG. 5, and FIG. 7 is a side view of the cleat attachment structure of FIG. 5.

As with the FIG. 1 embodiment, the FIG. 5 embodiment allows the traction cleat to securely be attached to a receptacle embedded in footwear. The cleat attachment structure consists of a cylindrical structure 20 or "cylinder" attached to the top face of the attachment structure. The cylinder 20 defines a cavity 28. The outer surface of the cylinder 20 includes a plurality of locking tabs 22. The locking tabs engage with one or more corresponding locking tabs on the inner surface of a cylindrical cavity in a receptacle in the footwear outsole. The engagement of the locking tabs 22 holds the cleat attachment structure 50—and thus the entire cleat—in the receptacle. Slots 26 may be formed in the walls of the cylinder 20 to facilitate flexing of the tabs 22 as the tabs engage a corresponding locking tab or tabs in the receptacle. The widths and number of locking tabs may vary in various preferred embodiments to vary the force needed to insert the cleat into the receptacle and the force needed to disengage the cleat from the receptacle. Preferably, as shown in FIG. 6 (as well as FIG. 2), the locking tabs 22 are disposed on a sector of the cylinder 20 extending greater than 180 degrees around the cylinder.

Again, as with the FIG. 1 embodiment, the cleat attachment structure of FIGS. 5, 6 and 7 also includes a ramp 24. The ramp 24 extends from the top end of the cylinder 20 towards the bottom end of the cylinder. Preferably, the ramp 24 is disposed on a sector of the cylinder extending less than 90 degrees around the cylinder. The ramp 24 mates with a corresponding ramp in a cylindrical cavity in the receptacle. When the cleat is twisted about the central axis of the cylindrical structure 20, these ramps translate the cleat attachment structure vertically along the central axis, relative to the receptacle. This axial movement disengages the locking tabs of cleat and receptacle, allowing the cleat to be removed from the footwear. As noted above, in some embodiments of the invention, more than one ramp may be provided on each of the cleat attachment structure and the receptacle.

There are several differences between the embodiments of FIGS. 1 and 5, including the number of locking tabs 22. The primary difference, however, is that the FIG. 5 embodiment includes an inner cylindrical core 55, which cooperates with a corresponding structure (item 85, discussed below in connection with FIGS. 8, 9 and 10) on the receptacle in order to help line up the cleat and receptacle for insertion. This alignment core 55 is located within the cavity 28 defined by the cylinder 20 and is coaxially aligned about the central axis of cylinder.

The alignment core 55 may also include a vertical flange 57 to help rotationally orient the cleat and the receptacle for proper insertion of the cleat, and in particular to help align the ramps of the cleat and receptacle to each other. This alignment core 55 may also include an arrow 56 to help the user visually orient the cleat and the receptacle for insertion of the cleat into the receptacle.

The vertical flange 57 of the alignment core 55 may also include a vertical wall 59 that can interact with a corresponding wall (item 91, discussed below in connection with FIGS. 8, 9 and 10) in the receptacle to resist rotation of the cleat attachment structure (and the cleat) with respect to the receptacle after the cleat has been installed in the receptacle.

As shown in FIG. 7, the alignment core 55 has a greater height than the cylinder 20. This greater height makes it easier for the person inserting the cleat to properly align and orient the cleat attachment structure 50 with the receptacle before trying to snap the cleat into place in the receptacle.

Figure 8:
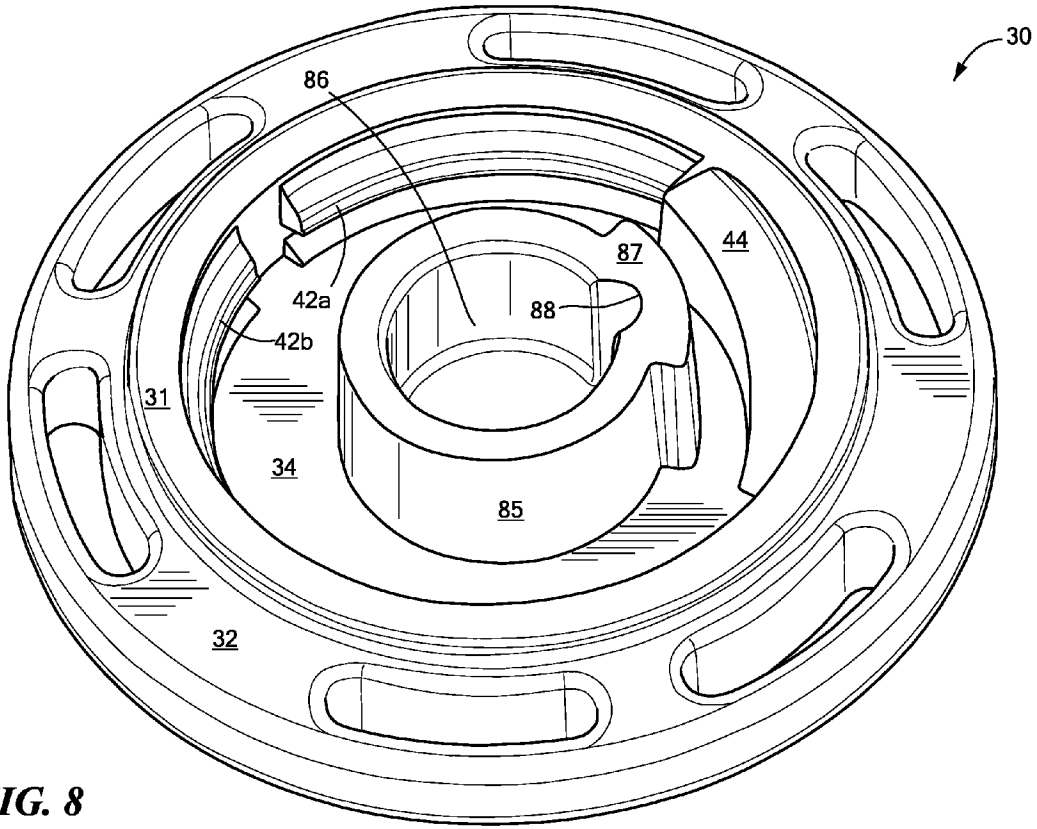
FIG. 8 is a bottom perspective view of a receptacle that receives a cleat attachment structure, such as the cleat attachment structure of FIG. 5, according to an embodiment of the invention.
Figure 9:
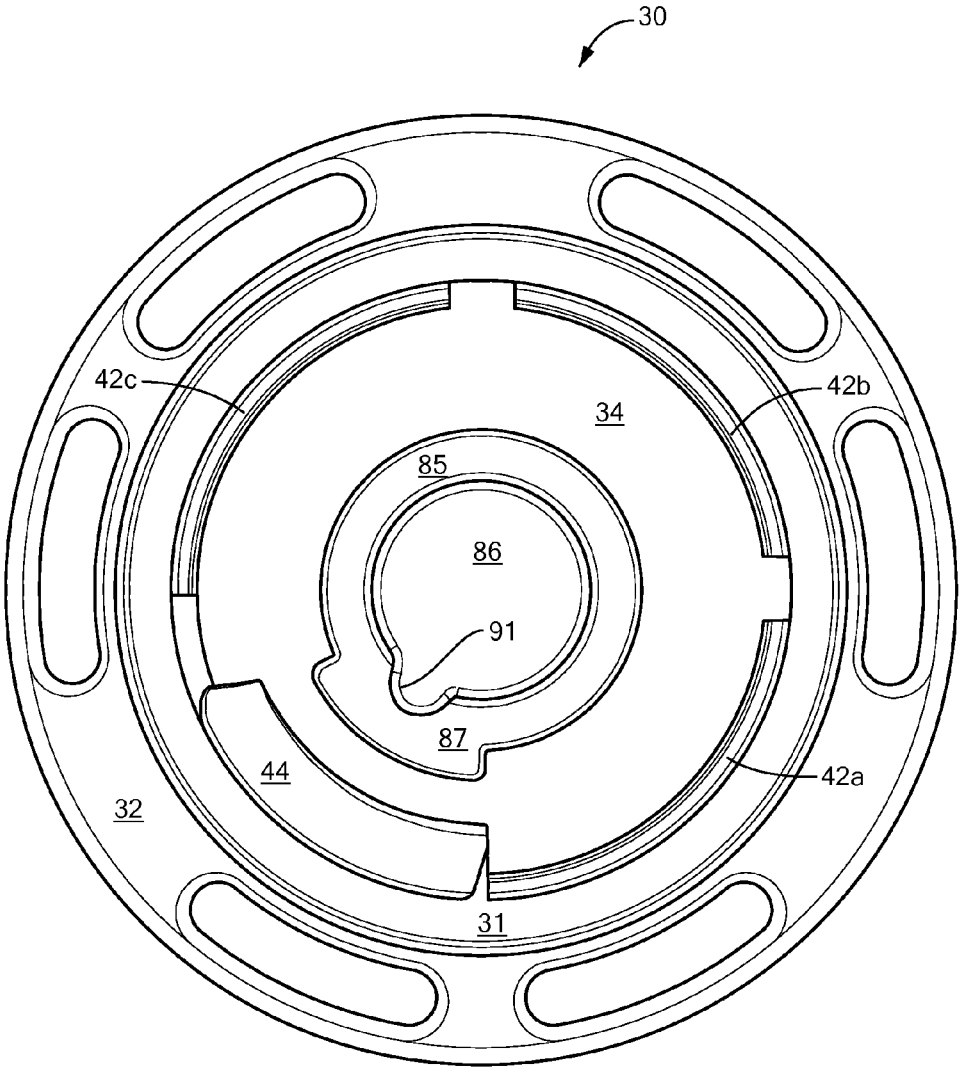
FIG. 9 is a bottom view of the receptacle of FIG. 8; this view is along the central axis of the receptacle's cylindrical cavity.
Figure 10:
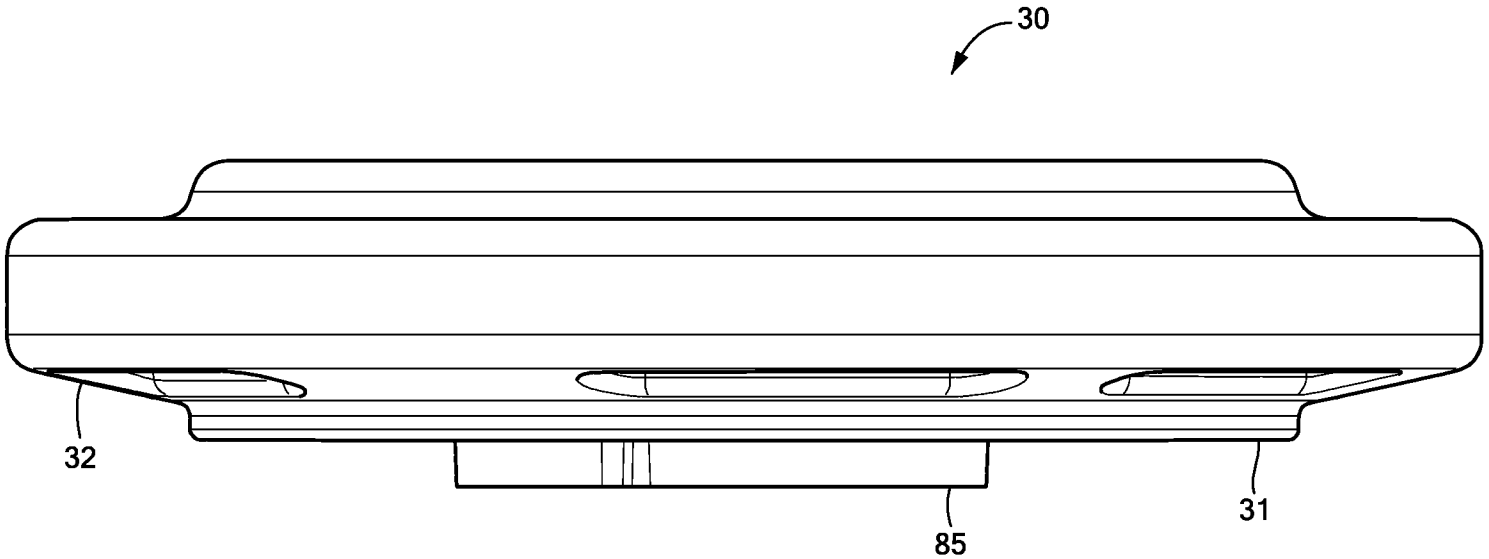
FIG. 10 is a side view of the receptacle of FIG. 8.

FIGS. 8, 9 and 10 depict an embodiment of a receptacle adapted to be used with the cleat attachment structure of FIGS. 5, 6 and 7. FIG. 8 is a bottom perspective view of the receptacle, FIG. 9 is a bottom view of the receptacle of FIG. 8, and FIG. 10 is a side view of the receptacle of FIG. 8.

Like the receptacle embodiment shown in FIGS. 3 and 4, the bottom face of the receptacle 30 shown in FIGS. 8, 9 and 10 includes a wall 31 defining a cylindrical cavity 34 that receives the cleat attachment structure and includes a flange 32 that allows the receptacle be molded into and retained in the outsole of footwear. The receptacle's locking tab is broken into three smaller locking tabs 42*a*, 42*b*, and 42*c*. The receptacle's ramp 44 cooperates with the corresponding ramp of the cleat attachment structure to disengage the cleat and receptacle when the cleat is twisted, as described above. The locking tabs 42*a*, 42*b*, and 42*c* cooperate with the corresponding locking tabs on the cleat attachment structure to retain the cleat attachment structure in the receptacle after insertion.

An inner cylindrical wall 85, which defines an inner cylindrical opening 86, is disposed within the cavity 34. The inner cylindrical opening 86 is coaxially aligned about the central axis of the cavity 34. The inner cylindrical wall 85 includes an expanded section 87 defining a slot 88, which can receive the flange (item 57 of FIGS. 5 and 6) of the cleat attachment structure in order to rotationally orient the cleat properly for insertion into the receptacle. The geometries of the slot 88 and the corresponding flange 57 of the cleat attachment structure also preferably complement each other so as to limit the amount of rotational play of the cleat in the receptacle.

The slot 88 includes a vertically oriented wall 91 adapted to cooperate with the corresponding wall (item 59 in FIGS. 5 and 6) in the cleat attachment structure in order to resist rotation of the cleat attachment structure (item 50 in FIGS. 5, 6 and 7) about the central axis after it has been inserted into the receptacle 30. The geometry of the corresponding walls (the wall 59 in the cleat attachment structure of FIGS. 5, 6 and 7, and the wall 91 on the slot 88 of the receptacle of FIGS. 8, 9 and 10), as well as the materials from which these corresponding walls are made, may be modified to adjust the amount of torque necessary to twist the cleat out of the receptacle.

Preferably, the height of the receptacle's inner cylindrical wall 85 is greater than the height of the receptacle's wall 31, as shown in FIG. 10. This greater height of the inner cylindrical wall 85, along with the alignment core 55 extending beyond the top of the cleat attachment structure's cylinder 20 (see FIG. 7), makes it easier for the person inserting the cleat to properly align and orient the cleat attachment structure 50 with the receptacle 30 before trying to snap the cleat into place in the receptacle. The alignment core 55 and vertical flange 57 of the cleat attachment structure work with the receptacle's inner cylindrical opening 86 and slot 88 to help align and rotationally orient the cleat and the receptacle for proper insertion of the cleat, and in particular to help align the ramps of the cleat and receptacle to each other.

Like the cleat and receptacle embodiments shown respectively in FIGS. 1 and 2 and in FIGS. 3 and 4, the cleat and receptacle embodiments shown respectively in FIGS. 5, 6 and 7 and in FIGS. 8, 9 and 10 are attached to each other with a simple snapping action and are detached from each other with a simple, partial-turn twisting action (preferably, less than a 180 degree turn, and more preferably, less than a 90 degree turn). After proper alignment of the cleat and receptacle, the cleat is simply pushed and snapped into place in the receptacle, so that the locking tabs on each of the cleat and the receptacle overlap each other to hold the cleat in the receptacle. For removal, the cleat is twisted with respect to the receptacle, preferably with a cleat wrench, which causes the ramps of the cleat and the receptacle to interact with each other, causing the cleat to move axially with respect to the receptacle, and in turn causing the locking tabs to bend so as to overcome the force of the locking tabs holding the cleat in place.

It is desirable in some footwear to reduce the thickness of the outsole in which a receptacle is installed. Thickness reduction for an outsole can save weight and reduce the cost as compared to a thicker outsole. Preferred embodiments of the invention allow reduced height receptacle and corresponding cleat attachment structures as compared to conventional cleat attachment systems that employ screw threads, for example. Such thickness reduction can occur because retention of the cleat in the receptacle is provided by the cooperation of the locking tabs, which can be on about the same plane in receptacle and the cleat. In a preferred embodiment of the invention, the height of a receptacle can be 4 mm or less.

In other embodiments of the invention, the cleat attachment structure and the attachment structure for the receptacle may be swapped so that the cleat includes the cylindrical cavity (as shown in FIGS. 3 and 4 or in FIGS. 8, 9 and 10) and the receptacle includes the cylindrical structure (as shown in FIGS. 1 and 2 or in FIGS. 5, 6 and 7). Alternatively, just the inner aligning structures of the cleat and receptacle (respectively, the core 55 shown in FIGS. 5, 6 and 7, and the inner cylindrical wall 85 shown in FIGS. 8, 9 and 10) may be swapped between the cleat and the receptacle.

In various embodiments of the invention, system components can be made of any of a variety of materials, including plastic and metal. The components may be fabricated by processes typical for such components such as injection molding, die cut and assembly (adhered, glued, etc.), compression and flow molding, casting, etc.

Similarly, it is of course apparent that the present invention is not limited to the detailed description set forth above. Various changes and modifications of this invention as described will be apparent to those skilled in the art without departing from the spirit and scope of this invention as defined in the appended claims.

I claim:

1. An attachment structure for a removable cleat, the attachment structure comprising:

a base; and a continuous cylinder disposed about a central axis about which the attachment structure may be rotated to disengage the attachment structure from a receptacle, the cylinder projecting from a top surface of the base, the cylinder having a bottom end adjacent the top surface of the base and a top end disposed further from the base than the bottom end, the cylinder including:

at least one locking tab disposed on and projecting from an outer surface of the cylinder, wherein the locking tab is oriented substantially transverse to the central axis; and at least one ramp disposed on and projecting from the outer surface of the cylinder, and extending from the bottom end of the cylinder towards the top end of the cylinder.

2. The attachment structure according to claim 1 wherein the cylinder includes a plurality of locking tabs.

3. The attachment structure according to claim 2 wherein the locking tabs are disposed on a sector of the cylinder extending greater than 180 degrees around the cylinder.

4. The attachment structure according to claim 3, wherein the ramp is disposed on a sector of the cylinder extending less than 90 degrees around the cylinder.

5. The attachment structure according to claim 1 wherein the ramp is adapted to cooperate with a corresponding ramp in the receptacle to disengage the locking tab from the receptacle when the attachment structure is rotated about its central axis.

6. The attachment structure of claim 5, further including a cylindrical core disposed about the central axis and within a perimeter defined by the cylinder.

7. The attachment structure of claim 6, wherein the core includes a vertically oriented wall adapted to cooperate with a corresponding wall in the receptacle to resist rotation of the attachment structure about its central axis.

8. The attachment structure of claim 7, wherein the cylinder has a vertical height and the core has a vertical height, and the height of the core is greater than the height of the cylinder.

9. The attachment structure of claim 6, wherein the cylinder has a vertical height and the core has a vertical height, and the height of the core is greater than the height of the cylinder.

10. A receptacle adapted to be molded into a footwear outsole and to receive an attachment structure for a removable cleat, the receptacle comprising:

a base;

a cylindrical cavity in the base, the cavity having an inner cylindrical surface and a closed end proximate to a bottom surface of the base, the cavity disposed about a central axis about which the attachment structure may be rotated to disengage the attachment structure from the receptacle, the cylindrical cavity including at least one locking tab disposed on and projecting from the inner cylindrical surface of the cylindrical cavity, wherein the locking tab is oriented substantially transverse to the central axis; and at least one ramp disposed on and projecting from the inner cylindrical surface, and extending from the closed end of the cylindrical cavity towards the open end of the cavity.

11. The receptacle according to claim 10 wherein the cylindrical cavity includes a plurality of locking tabs.

12. The receptacle according to claim 10 wherein the ramp is adapted to cooperate with a corresponding ramp in the attachment structure to disengage the attachment structure form the receptacle when the attachment structure is rotated about the central axis.

13. The receptacle according to claim 12, further including an inner cylindrical wall defining an inner cylindrical opening disposed about the central axis and within the cavity.

14. The receptacle according to claim 13, wherein the inner cylindrical opening includes a vertically oriented wall adapted to cooperate with a corresponding wall in the attachment structure to resist rotation of the attachment structure about the central axis.

15. The receptacle according to claim 14, wherein the cavity has a vertical height and the inner cylindrical opening has a vertical height, and the height of the inner cylindrical opening is greater than the height of the cavity.

16. The receptacle according to claim 13, wherein the cavity has a vertical height and the inner cylindrical opening has a vertical height, and the height of the inner cylindrical opening is greater than the height of the cavity.

17. An attachment system for connecting a removable cleat to a footwear outsole, the attachment system comprising:

a cleat attachment structure including:

a cleat base; and a cylinder disposed about a cleat central axis, the top end of the cylinder projecting from a top surface of the cleat base, the cylinder including:

at least one locking tab disposed on and projecting from an outer surface of the cylinder, wherein the locking tab is oriented substantially transverse to the cleat central axis; and at least one ramp disposed on and projecting from the outer surface of the cylinder, and extending from the bottom end of the cylinder towards the top end of the cylinder; and a receptacle adapted to be molded into the outsole of the athletic shoe and to receive and hold the cleat attachment structure, the receptacle including:

a receptacle base;

a cylindrical cavity in the receptacle base disposed about a receptacle central axis, the cavity having an inner cylindrical surface and a closed end proximate to a bottom surface of the receptacle base, the cylindrical cavity including:

at least one locking tab disposed on and projecting from the the inner cylindrical surface of the cylindrical cavity, wherein the locking tab is oriented substantially transverse to the receptacle central axis; and at least one ramp disposed on and projecting from the inner cylindrical surface, and extending from the closed end of the cylindrical cavity towards the open end of the cylindrical cavity, wherein the locking tab of the cleat attachment structure and the locking tab of the receptacle engage when the central axis of the cleat attachment structure is aligned with the central axis of the receptacle and the cleat attachment structure is inserted into the receptacle.

18. The attachment system according to claim 17 wherein the at least one ramp of the cleat attachment structure and the at least one ramp of the receptacle are adapted to disengage the cleat attachment structure from the receptacle when the cleat attachment structure is rotated about its central axis.

19. An attachment system for connecting a removable cleat to an outsole of an athletic shoe, the attachment system comprising:

a cleat attachment structure including:

a cleat base;

a cylindrical cavity in the cleat base, the cavity disposed about a cleat central axis, the cavity having an inner surface and a closed end proximate to a top surface of the cleat base, the cylindrical cavity including:

at least one locking tab disposed about the inner surface of the cylindrical cavity; and at least one ramp extending from the closed end of the cylindrical cavity towards the open end of the cylindrical cavity; and a receptacle adapted to be molded into the outsole of the athletic shoe and to receive and hold the cleat attachment structure, the receptacle including:

a receptacle base;

a cylinder disposed about a receptacle central axis, the top end of the cylinder projecting from a bottom surface of the receptacle base, the cylinder including:

at least one locking tab disposed about the outer surface of the cylinder; and at least one ramp extending from the bottom end of the cylinder towards the top end of the cylinder; and wherein the locking tab of the cleat attachment structure and the locking tab of the receptacle engage when the central axis of the cleat attachment structure is aligned with the central axis of the receptacle and the cleat attachment structure is inserted into the receptacle.

20. The attachment system according to claim 19 wherein the at least one ramp of the cleat attachment structure and the at least one ramp of the receptacle are adapted to disengage the cleat attachment structure from the receptacle when the cleat attachment structure is rotated about its central axis.

21. Footwear having a cleat attachment system of claim 17.

22. Footwear having a cleat attachment system of claim 19.

23. A method of connecting a removable cleat to an outsole of an athletic shoe, comprising:

providing an attachment system comprising:

a cleat attachment structure including:

a cleat base; and a cylinder disposed about a cleat central axis, the top end of the cylinder projecting from a top surface of the cleat base, the cylinder including:

at least one locking tab disposed on and projecting from an outer surface of the cylinder, wherein the locking tab is oriented substantially transverse to the cleat central axis; and at least one ramp extending from the bottom end of the cylinder towards the top end of the cylinder; and a receptacle adapted to be molded into the outsole of the athletic shoe and to receive and hold the cleat attachment structure, the receptacle including:

a receptacle base;

a cylindrical cavity in the receptacle base disposed about a receptacle central axis, the cavity having an inner cylindrical surface and a closed end proximate to a bottom surface of the receptacle base, the cylindrical cavity including:

at least one locking tab disposed on and projecting from the inner cylindrical surface of the cylindrical cavity, wherein the locking tab is oriented substantially transverse to the receptacle central axis; and at least one ramp disposed on and projecting from the inner cylindrical surface, and extending from the closed end of the cylindrical cavity towards the open end of the cylindrical cavity, aligning the central axis of the cleat attachment structure with the central axis of the receptacle;

rotating the cleat attachment structure to align the at least one ramp of the cleat attachment structure with the at least one ramp of the receptacle; and inserting the cleat attachment structure into the receptacle, engaging at least one locking tab of the cleat attachment structure with at least one locking tab of the receptacle.

24. The method according to claim 23, further including:

disengaging at least one locking tab of the cleat attachment structure from at least one locking tab of the receptacle by twisting the cleat attachment structure about its axis.

* * * * *